US007293485B2

(12) United States Patent
Engvall et al.

(10) Patent No.: US 7,293,485 B2
(45) Date of Patent: Nov. 13, 2007

(54) QUICK ADJUSTING PLIERS

(75) Inventors: David P. Engvall, Huntersville, NC (US); Jeffery L. Ditzler, Lincoln, NE (US); Gene L. Tyser, Wilbur, NE (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 11/473,939

(22) Filed: Jun. 23, 2006

(65) Prior Publication Data

US 2006/0243103 A1 Nov. 2, 2006

Related U.S. Application Data

(63) Continuation of application No. 11/190,989, filed on Jul. 27, 2005, now Pat. No. 7,089,832, which is a continuation of application No. 10/718,782, filed on Nov. 21, 2003, now Pat. No. 7,040,201, which is a continuation-in-part of application No. 10/406,621, filed on Apr. 2, 2003, now Pat. No. 7,100,480.

(51) Int. Cl.
*B25B 7/04* (2006.01)

(52) U.S. Cl. ..... 81/413; 81/391; 81/392

(58) Field of Classification Search ..... 81/405, 81/407–409, 409.5, 413–414, 391–393, 352–360, 81/347; 269/212, 215
See application file for complete search history.

(56) References Cited

U.S. PATENT DOCUMENTS 2,727,417 A 12/1955 Eifel
3,176,551 A 4/1965 Hansen
3,192,805 A 7/1965 Manning
4,232,573 A 11/1980 Dace, Jr.
4,296,655 A 10/1981 Tesoro
4,438,669 A 3/1984 Hastings et al.
4,603,607 A 8/1986 Schaffner, Jr.
4,662,252 A 5/1987 Warheit
4,719,827 A 1/1988 Igarashi
4,753,140 A 6/1988 Majima
4,893,530 A 1/1990 Warheit
4,901,609 A 2/1990 Crum
4,922,770 A 5/1990 Dlugolecki et al.

(Continued)

FOREIGN PATENT DOCUMENTS

DE 27941 7/1914

(Continued)

*Primary Examiner*—D. S. Meislin
(74) *Attorney, Agent, or Firm*—Dennis J. Williamson; Moore & Van Allen PLLC

(57) ABSTRACT

A method and device is disclosed for clamping an object with quick adjusting pliers. A top jaw has a bottom handle, a slot, and a series of ridges located around the slot. A pin extends through the slot and includes an engagement element. A bottom jaw has a top handle and another opening for receiving the pin. The engagement element engages at least one of the series of ridges in a first position, wherein the top jaw and bottom jaw pivot about a first axis that extends through a longitudinal axis of the pin, and wherein the engagement element is moveable along the first axis from the first position to a second position wherein the engagement element does not engage any of the series of ridges.

2 Claims, 10 Drawing Sheets

U.S. PATENT DOCUMENTS

| | | | |
|---|---|---|---|
| 5,060,543 | A | 10/1991 | Warheit |
| 5,134,908 | A | 8/1992 | Fisher |
| 5,351,584 | A | 10/1994 | Warheit |
| 5,660,089 | A | 8/1997 | Chow |
| 5,850,768 | A | 12/1998 | Chow |
| 6,000,303 | A | 12/1999 | Chang |
| 6,019,020 | A | 2/2000 | Liou |
| 6,101,908 | A | 8/2000 | Azkona |
| 6,161,455 | A | 12/2000 | Ping |
| 6,199,458 | B1 | 3/2001 | Wrigley et al. |
| 6,199,459 | B1 | 3/2001 | Azkona |
| 6,212,978 | B1 | 4/2001 | Seber et al. |
| 6,227,081 | B1 | 5/2001 | Bally et al. |
| 6,279,431 | B1 | 8/2001 | Seber et al. |
| 6,311,588 | B1 | 11/2001 | St. John et al. |
| 6,318,217 | B1 | 11/2001 | Emhardt et al. |
| 6,327,943 | B1 | 12/2001 | Wrigley et al. |
| 6,378,404 | B1 | 4/2002 | Bally et al. |
| 6,467,380 | B1 | 10/2002 | Azkona |
| 6,892,609 | B2 | 5/2005 | Kuo |
| 2002/0139227 | A1 | 10/2002 | Azkona |

FOREIGN PATENT DOCUMENTS

| | | | |
|---|---|---|---|
| DE | 9003713 | U1 | 5/1990 |
| DE | 9113870 | U1 | 12/1992 |
| DE | 19909224 | A1 | 9/2000 |
| DE | 19963818 | A1 | 7/2001 |
| DE | 20201841 | U1 | 8/2002 |
| DE | 202004015521 | U1 | 10/2005 |
| DE | 202005013501 | U1 | 11/2005 |
| GB | 2166382 | A | 5/1986 |
| GB | 2334913 | A | 9/1999 |
| WO | 9944790 | A1 | 9/1999 |

28
20
33
34
40
30
32
27
29
38
35
24
22
26b
26a

QUICK ADJUSTING PLIERS

This application is a continuation of prior U.S. patent application Ser. No. 11/190,989 filed Jul. 27, 2005, now U.S. Pat. No. 7,089,832, which was a continuation of prior U.S. patent application Ser. No. 10/718,782 filed Nov. 21, 2003 now U.S. Pat. No. 7,040,201, which was a continuation-in-part of U.S. patent application Ser. No. 10/406,621 filed Apr. 2, 2003 now U.S. Pat. No. 7,100,480.

BACKGROUND OF THE INVENTION

This invention relates generally to pliers devices, and more particularly to pliers devices that can be quickly adjusted to several positions.

SUMMARY OF THE INVENTION

The present invention provides a device and method for clamping an object with quick adjusting pliers. In particular, a device is provided with a top jaw having a bottom handle, a slot, and a series of ridges located around the slot. A pin, which includes an engagement element, is provided for extending through the slot. In addition, a bottom jaw is provided with a top handle and another opening for receiving the pin. The top jaw and bottom jaw pivot about an axis of the pin, and the engagement element is moveable along the same axis from a first position wherein the engagement element engages at least one of the series of ridges to a second position wherein the engagement element does not engage any of the series of ridges.

In one embodiment of the invention, the ridges are straight.

In another embodiment of the invention, the ridges are curved.

These and other features of the invention will become apparent upon review of the following detailed description of the presently preferred embodiments of the invention, taken into conjunction with the appended figures.

DETAILED DESCRIPTION OF THE PREFERRED EMBODIMENTS

Figure 1:
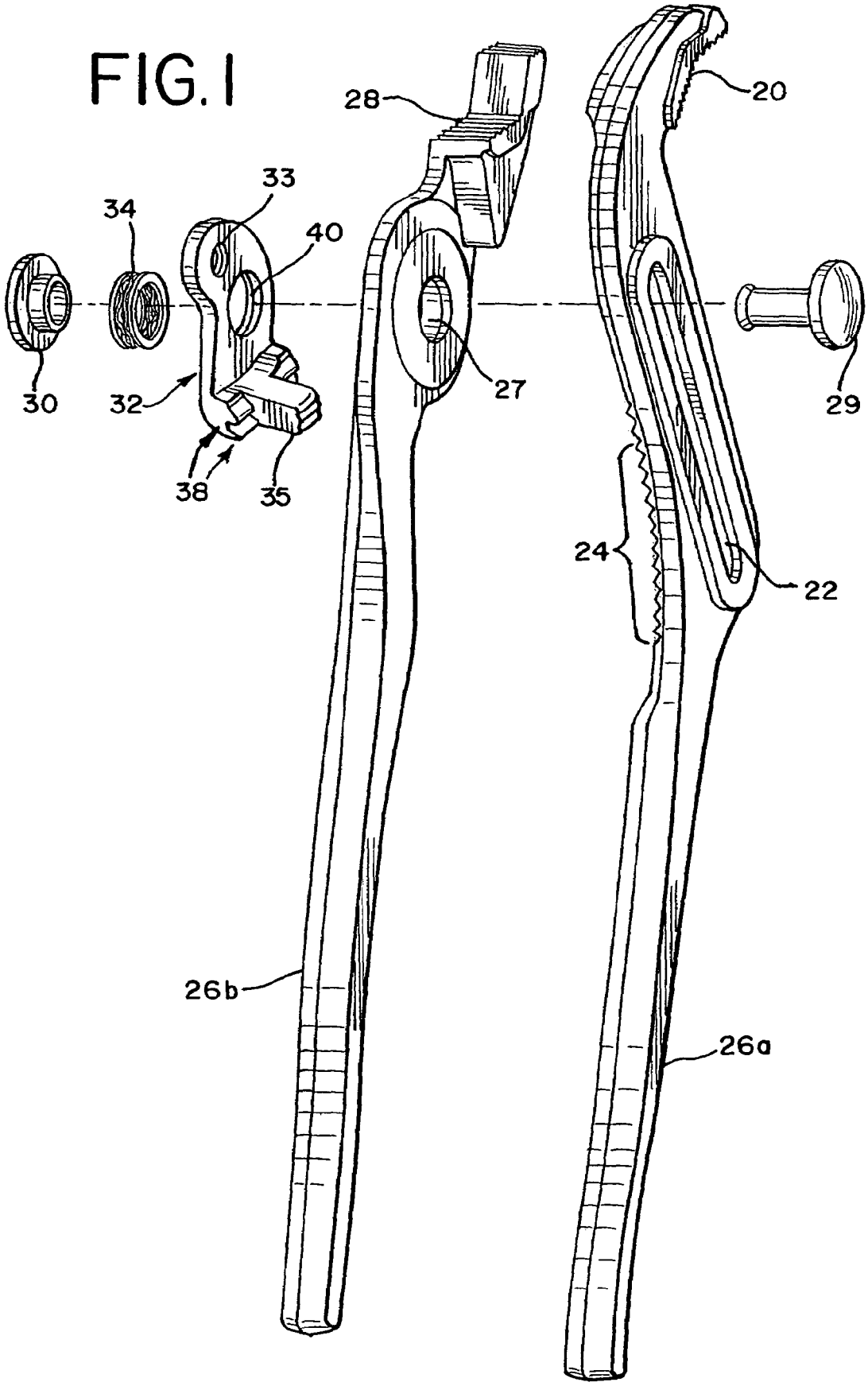
FIG. 1 is an exploded view of a quick adjusting pliers device according to a first embodiment of the present invention.
Figure 2:
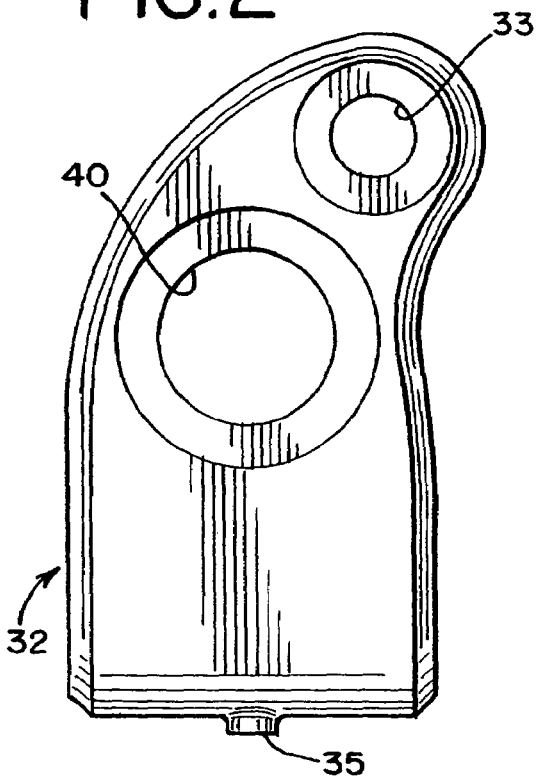
FIG. 2 is a top view of the tongue element of the quick adjusting pliers device of FIG. 1.
Figure 3:
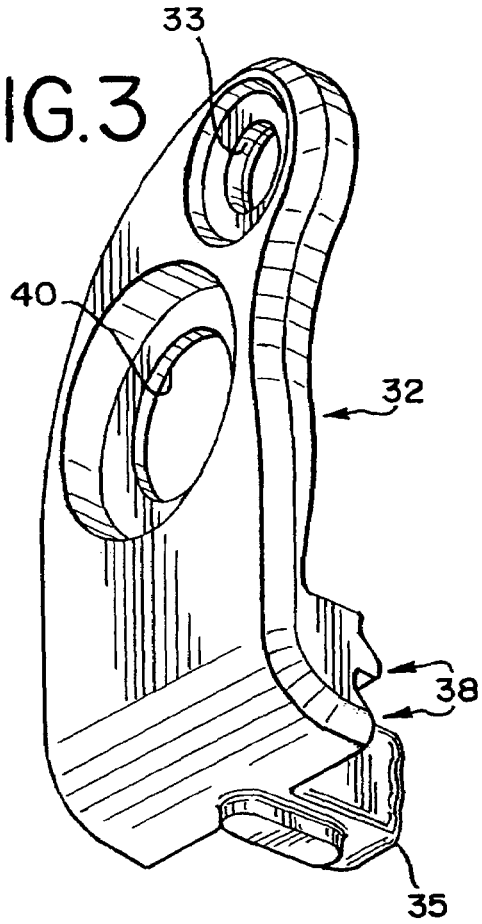
FIG. 3 is a perspective top view of the tongue element of the quick adjusting pliers device of FIG. 1.
Figure 4:
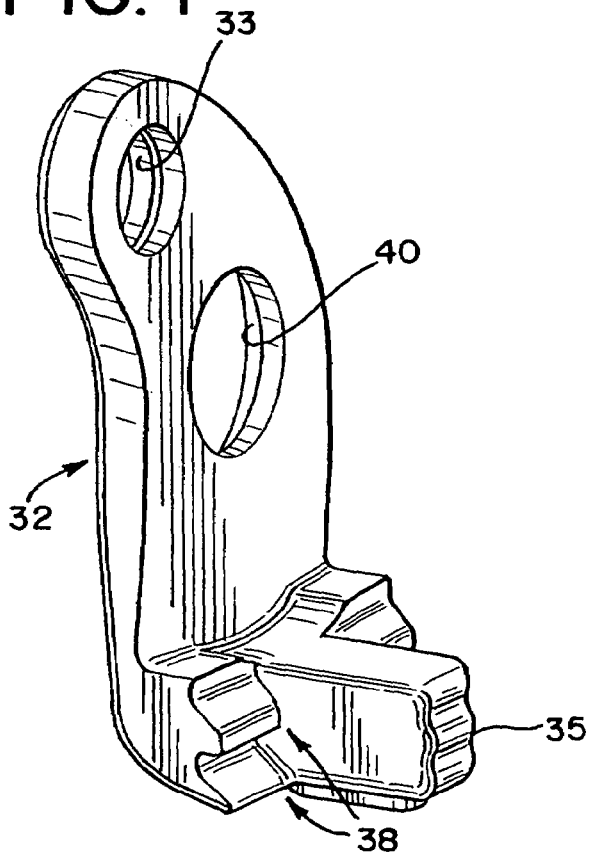
FIG. 4 is a perspective bottom view of the tongue element of the quick adjusting pliers device of FIG. 1.
Figure 5:
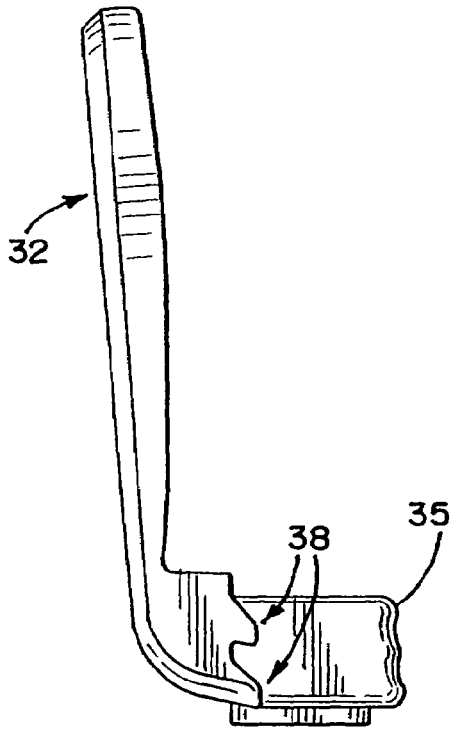
FIG. 5 is a left side view of the tongue element of the quick adjusting pliers device of FIG. 1.
Figure 6:
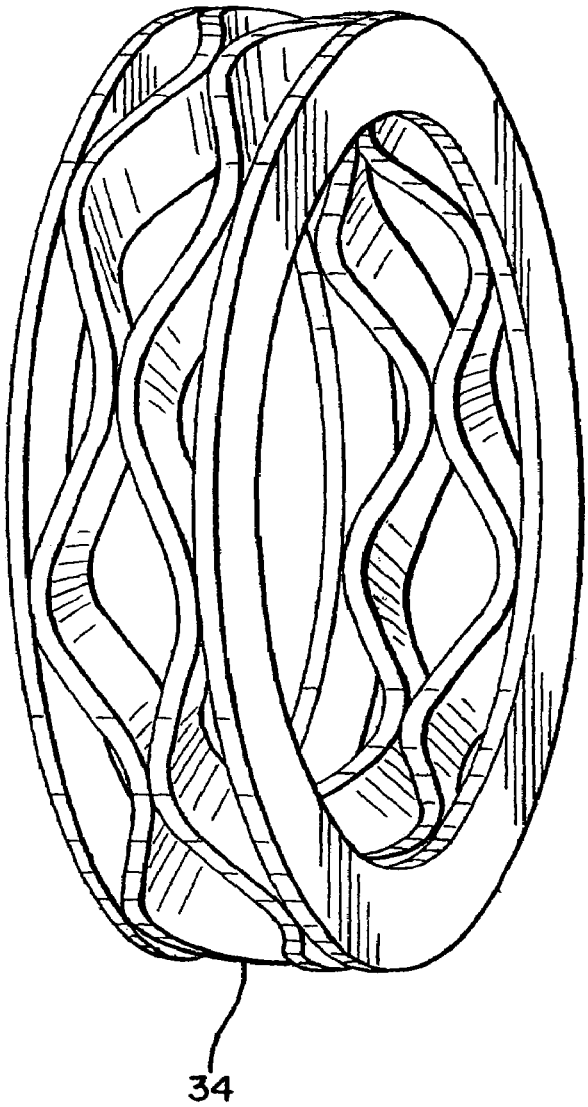
FIG. 6 is a perspective top view of the spring of the tongue element of the quick adjusting pliers device of FIG. 1.

Referring to FIG. 1, an exploded view of an embodiment in accordance with the quick adjusting pliers device of the present invention is shown. A top jaw 20 is integrally attached to a bottom handle 26*a*. The top jaw 20 has a slot 22 formed therein and has a series of ridges 24 formed on both sides of the slot 22 and above the bottom handle 26*a*. A bottom jaw 28 is integrally attached to a top handle 26*b* and has an opening 27 for receiving a pin 29. Pin 29 extends through an opening of a spring 34 (see FIG. 6), opening 40 of tongue element 32, opening 27 of bottom jaw 28, and slot. 22. With head 30, pin 29 pivotally connects the top jaw 20, bottom jaw 28, tongue element 32 and spring 34. Tongue element 32 is biased by spring 34.

FIGS. 2-5 illustrate the structure and rocker shape of tongue element 32 from various views. Tongue element 32 includes an extending portion 35 that extends through slot 22. The extending portion 35 keeps the tongue element aligned with the upper jaw 20. One or more teeth 38 are provided on tongue element 32 for engaging one or more of the series of ridges 24. Portion 35 extends in between and beyond teeth 38 underneath the top surface of tongue element 32. In order to promote translation of the tongue element 32 and bottom jaw 28 towards the top jaw 20, ridges 24 are angled towards top jaw 20 while teeth 38 are angled away from top jaw 20. Tongue element 32 and bottom jaw 28 are thus able to freely translate towards the top jaw 20 while being prevented by the ridges 24 from translating away from the top jaw 20. Accordingly, tongue element 32 is moveable relative to the ridges 24 to allow for engagement or disengagement with said ridges 24.

Figure 7:
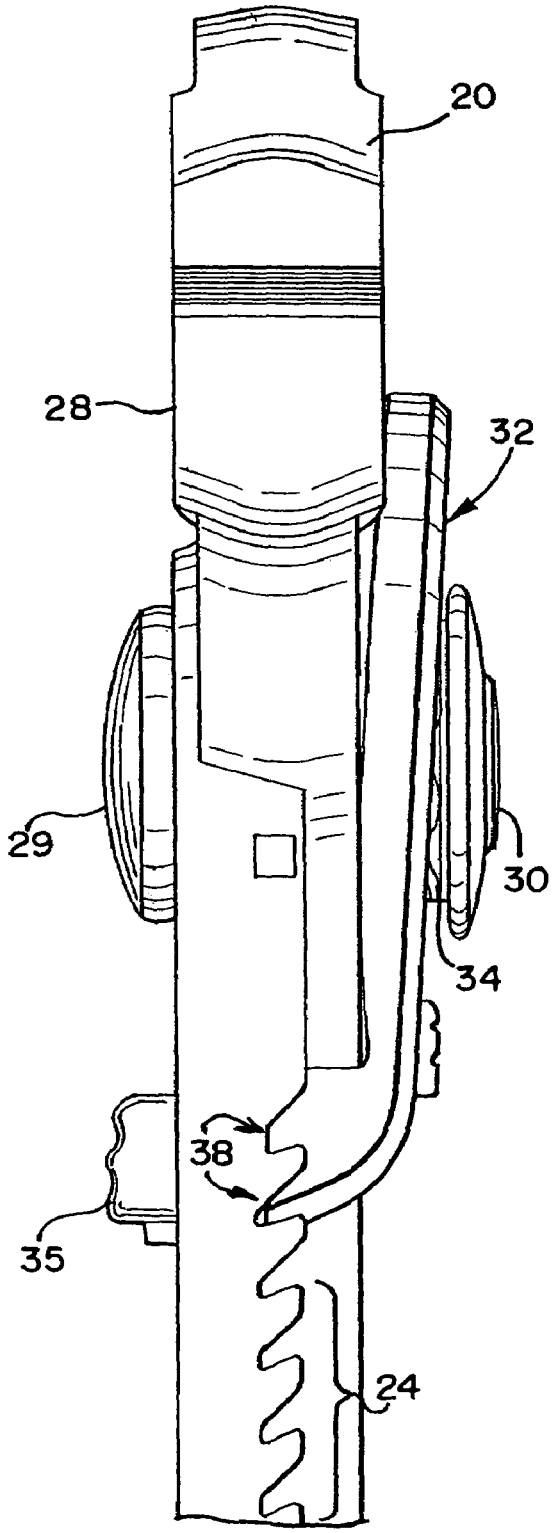
FIG. 7 is a left side view of the quick adjusting pliers device of FIG. 1, with the device in the closed position.
Figure 8:
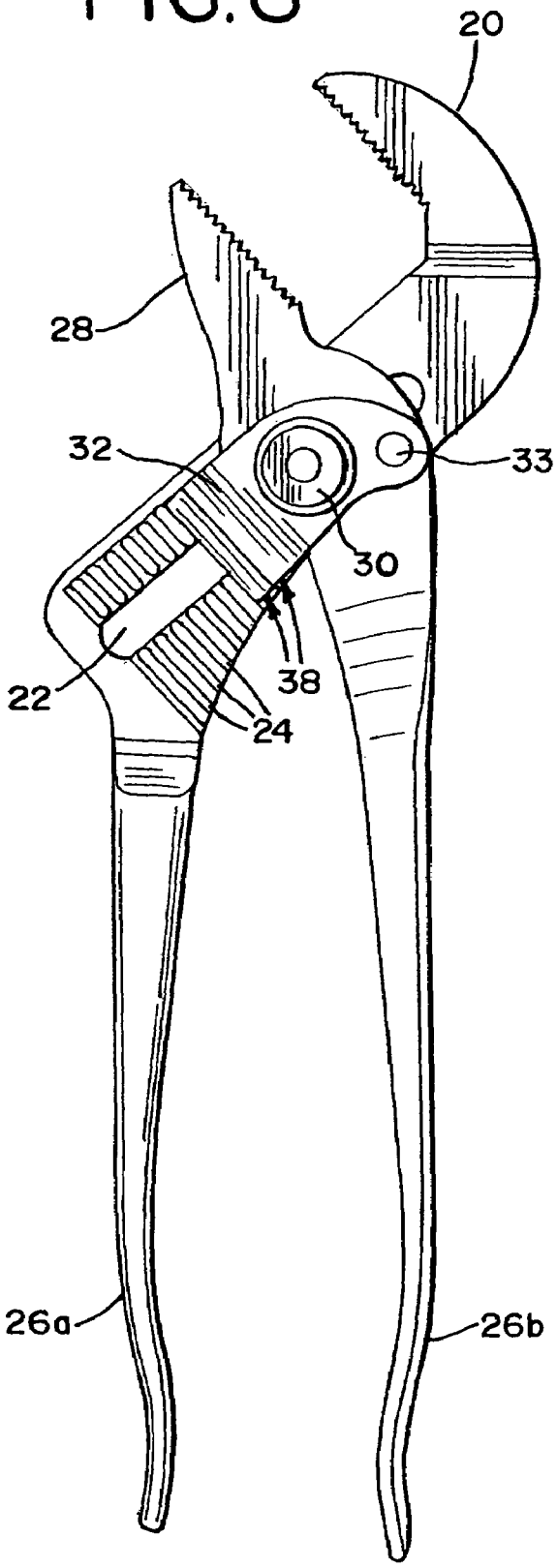
FIG. 8 is a front view of the quick adjusting pliers device of FIG. 1, with the device in an intermediate position of adjustment.
Figure 9:
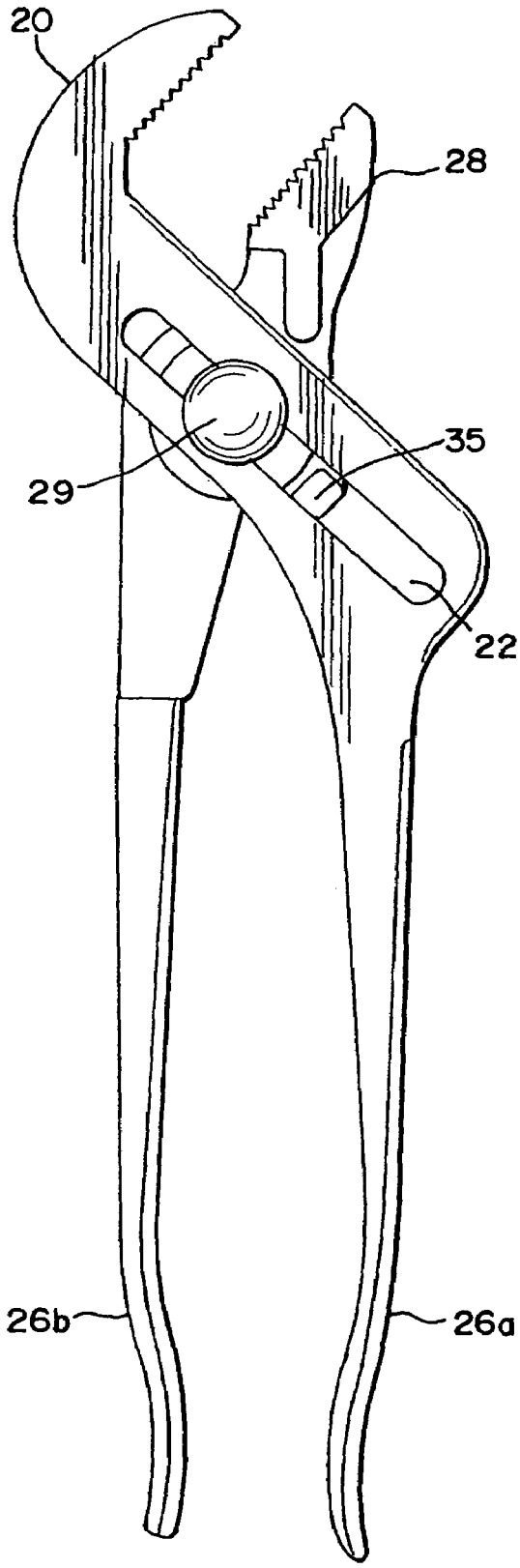
FIG. 9 is a back view of the quick adjusting pliers device of FIG. 1, with the device in an intermediate position of adjustment.

FIGS. 7-9 further illustrate the quick adjusting pliers device of FIG. 1. Ridges 24 are formed on both sides of the lower end of slot 22. As shown in FIG. 8, ridges 24 are straight in shape. However, curved ridges can also be used. Top jaw 20 and bottom jaw 28 pivot about a first axis that extends though a longitudinal axis of pin 29 and head 30. Tongue element 32 and bottom jaw 28 are moveable since tongue element 32 can be engaged and disengaged by ridges 24, as described above. With straight ridges, as shown, one or more teeth 38 can be used. With curved ridges, only one tooth 38 can be used.

As shown in FIG. 8, tongue element 32 includes a button 33. When pressed, button 33 pulls the teeth 38 of tongue element 32 out of the ridges 24. Thus, tongue element 32 pivots about a second axis that is perpendicular to the first axis so that bottom jaw 28 can move away from top jaw 20 and release an object. This allows the bottom jaw 28 to freely move towards or away from top jaw 20 to provide either a smaller or larger opening between the jaws of the device. Note that pressing extended portion 35 of the tongue element towards slot 22 pushes tongue element 32 out of the ridges 24 as well. Thus, pressing extended portion 35 also allows bottom jaw 28 to be moved towards or away from top jaw 20 to provide a smaller or larger opening between the jaws of the device.

IN order for the jaws of the device to clamp an object, the teeth 38 of tongue element 32 engage a ridge 24 that corresponds to the size of the object being clamped. Bottom jaw 28 then pivots about pin 29, which is transitionally fixed due to the engagement between the teeth of the tongue element and the correct ridge. When there is no object to be gripped and top jaw 20 and bottom jaw 28 contact one another, the tool can stay in this position, which allows for easy storage.

Figure 10:
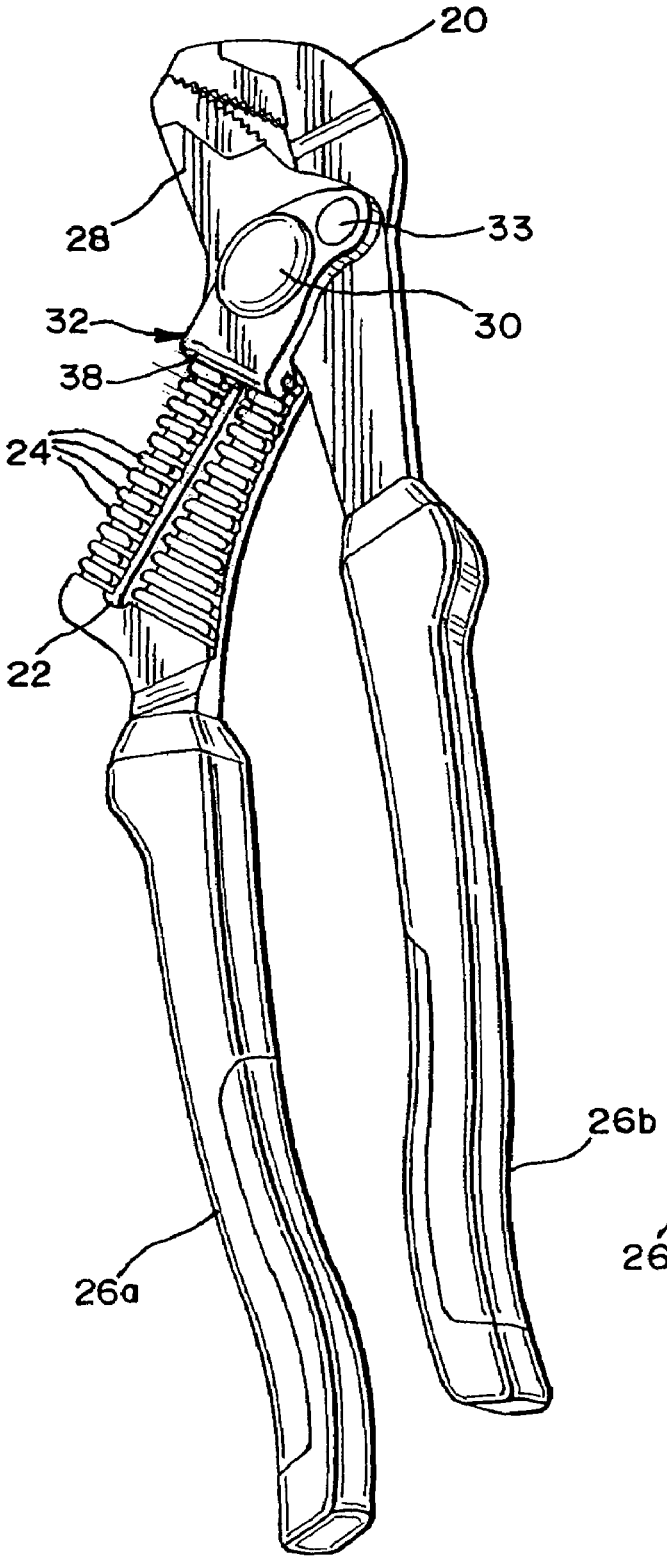
FIG. 10 is a front perspective view of a quick adjusting pliers device according to a first embodiment of the present invention, with the device in the closed position and with elastomeric handles.
Figure 11:
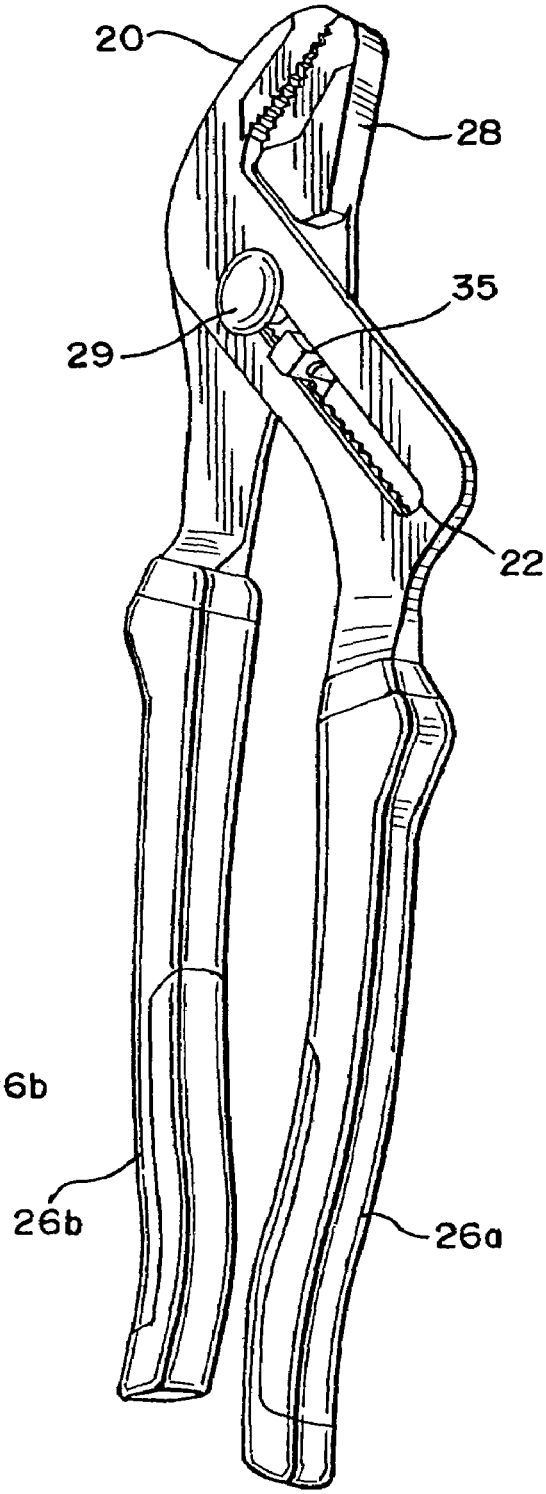
FIG. 11 is a back perspective view of the quick adjusting pliers device of FIG. 10, with the device in the closed position.

FIGS. 10-11 illustrate the first embodiment with the top jaw 20 and bottom jaw 28 of the device in the closed position. In addition, bottom handle 26*a* and top handle 26*b* have an elastomeric material fitted around their exteriors, making the handles slightly thicker.

Figure 12:
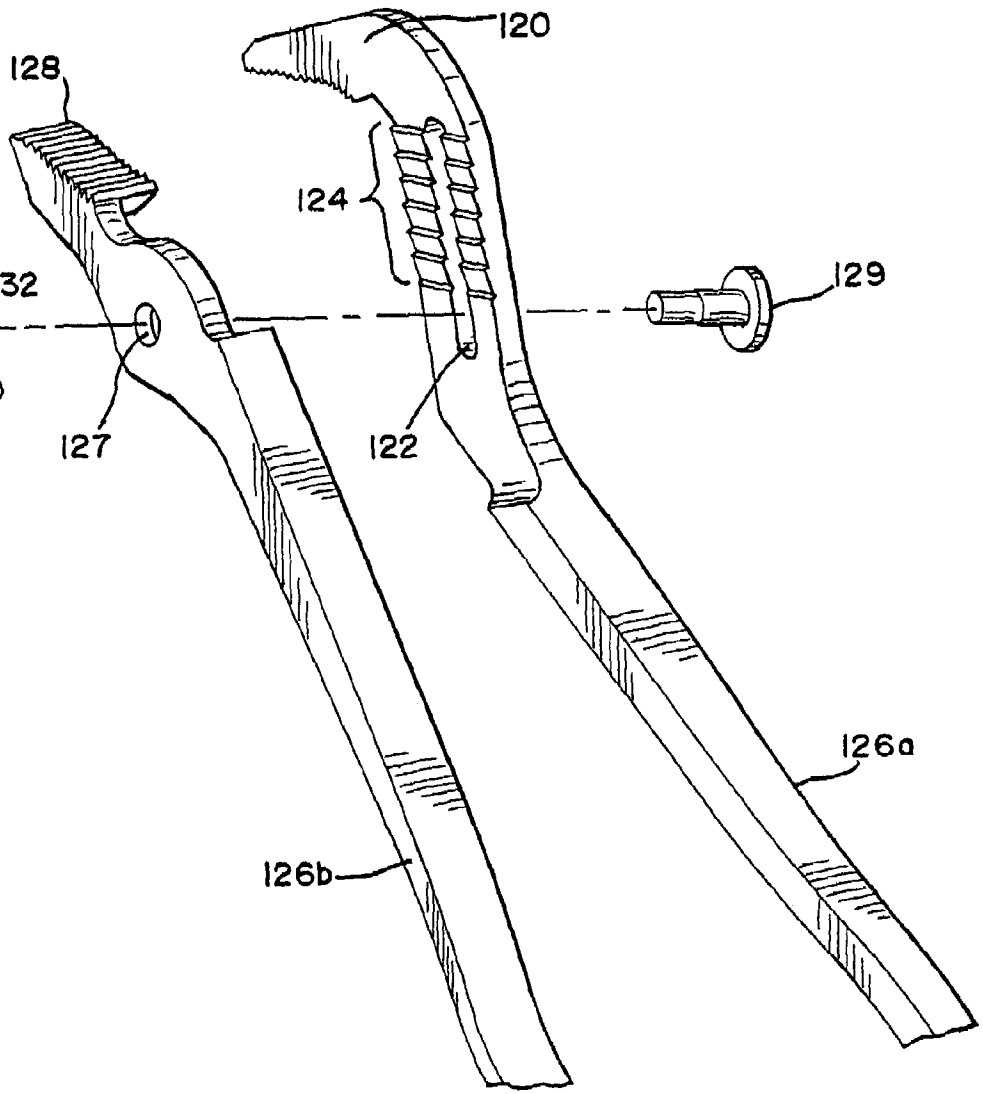
FIG. 12 is an exploded view of a quick adjusting pliers device according to a second embodiment of the present invention, with engagement of straight ridges above the pivot.
Figure 13:
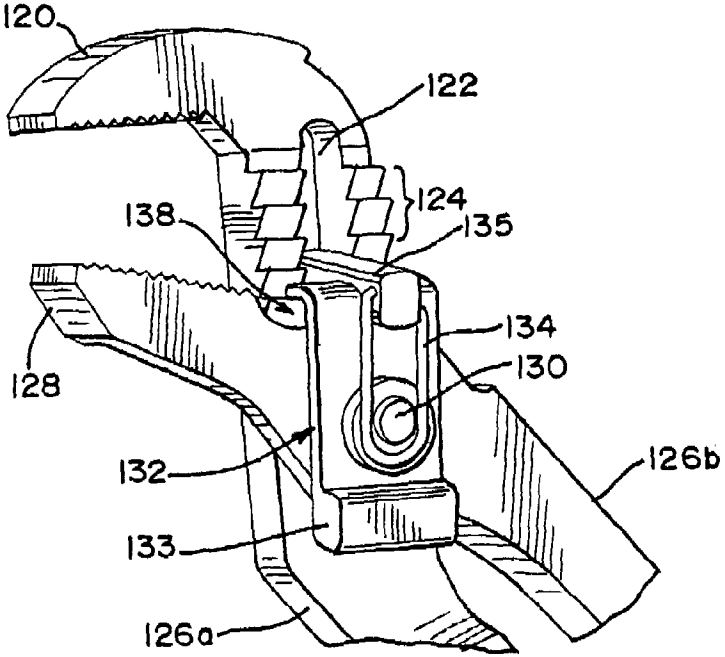
FIG. 13 is an enlarged perspective view of the quick adjusting pliers device of FIG. 12, with the device in the open position.

FIGS. 12-13 illustrate a second embodiment of the present invention. Ridges 124 are straight and located at the upper end of slot 122. However, curved ridges can also be used. Pin 129 extends through openings 127 and 140. Handles 126*a* and 126*b*, slot 122, pin 129 and head 130 are similar to, and function the same as corresponding items 26*a*, 16*b*, 22, 29 and 30, as described in the embodiment of FIGS. 1-9. Tongue element 132 has a somewhat different shape then tongue element 32 of the previous embodiment. Tongue element 132 has an extending portion 135 and teeth 138. With straight ridges, as shown, one or more teeth 38 can be used. With curved ridges, only one tooth 38 can be used. Tongue element 132 utilizes a raised surface 133 instead of a button to pull teeth 138 out of ridges 124 in a lever-like fashion. Spring 134 has a U-shape.

Figures 14, 15:
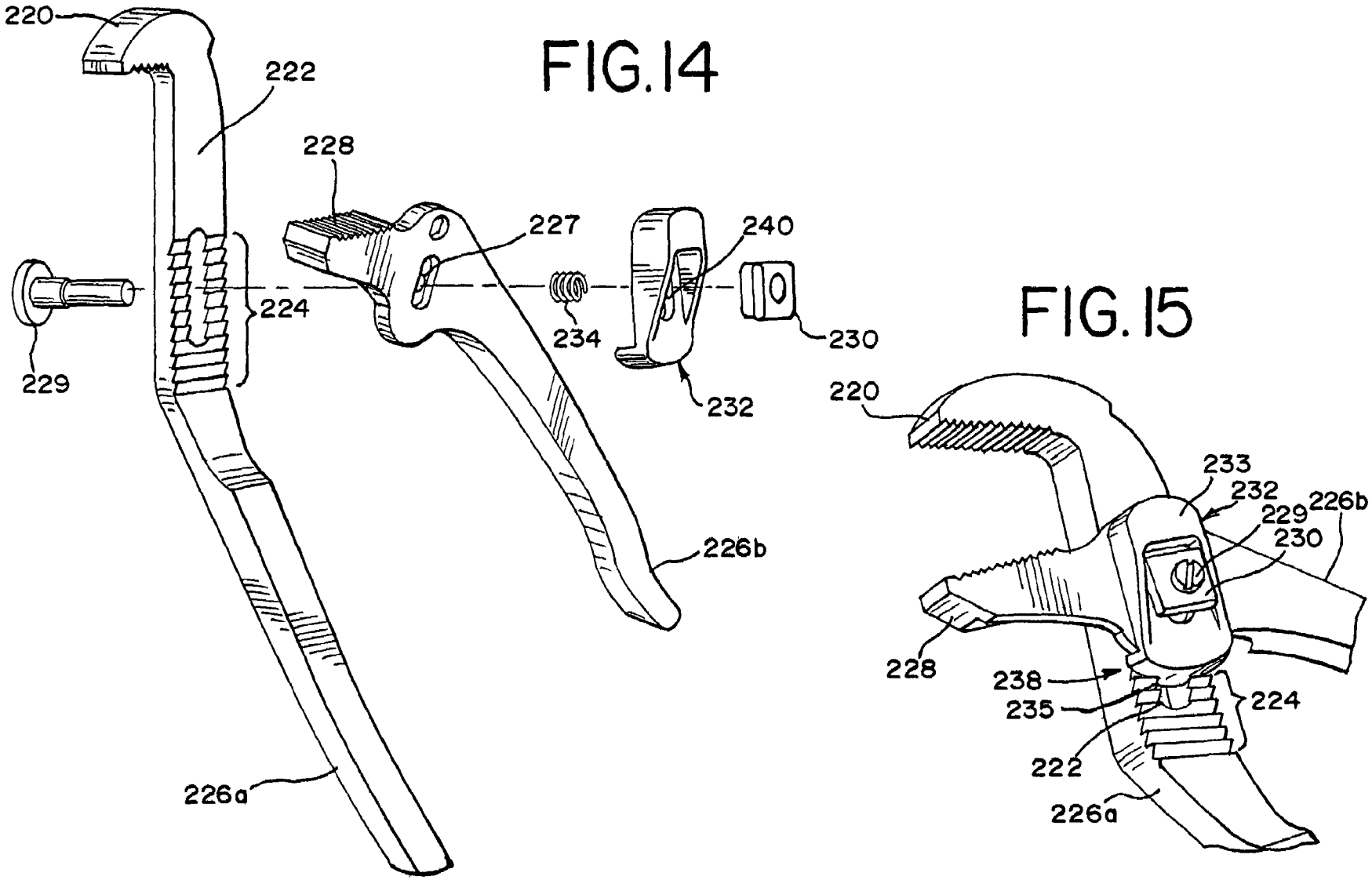
FIG. 14 is an exploded view of a quick adjusting pliers device according to a third embodiment of the present invention, with engagement of curved ridges below the pivot.
FIG. 15 is an enlarged perspective view of the quick adjusting pliers device of FIG. 14, with the device in an intermediate position.

FIGS. 14-15 illustrate a third embodiment of the present invention. Ridges 224 are curved and located at the lower end of slot 222. However, straight ridges can also be used. Pin 229 extends through openings 227 and 240. Handles 226*a* and 226*b*, slot 222, pin 229, and head 230 are similar to, and function the same as corresponding items 26*a*, 26*b*, 22, 29 and 30, as described in the embodiment of FIGS. 1-9. Tongue element 232 has an extending portion 235 and tooth 238. With curved ridges, as shown, only one tooth 238 can be used. With straight ridges, one or more teeth 238 can be used. Tongue element 232 utilizes a raised surface 233 instead of a button to pull tooth 238 out of ridges 224 in a lever-like fashion. Spring 234 has a coiled shape and operates in a manner similar to spring 34 of FIGS. 1-9.

Figure 16:
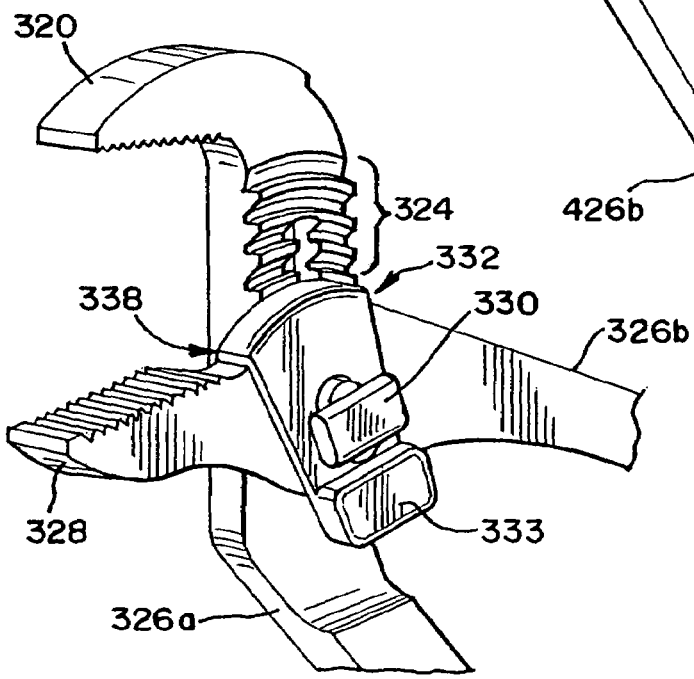
FIG. 16 is an enlarged perspective view of a quick adjusting pliers device according to a fourth embodiment of the present invention, with engagement of curved ridges above the pivot.
Figure 18:
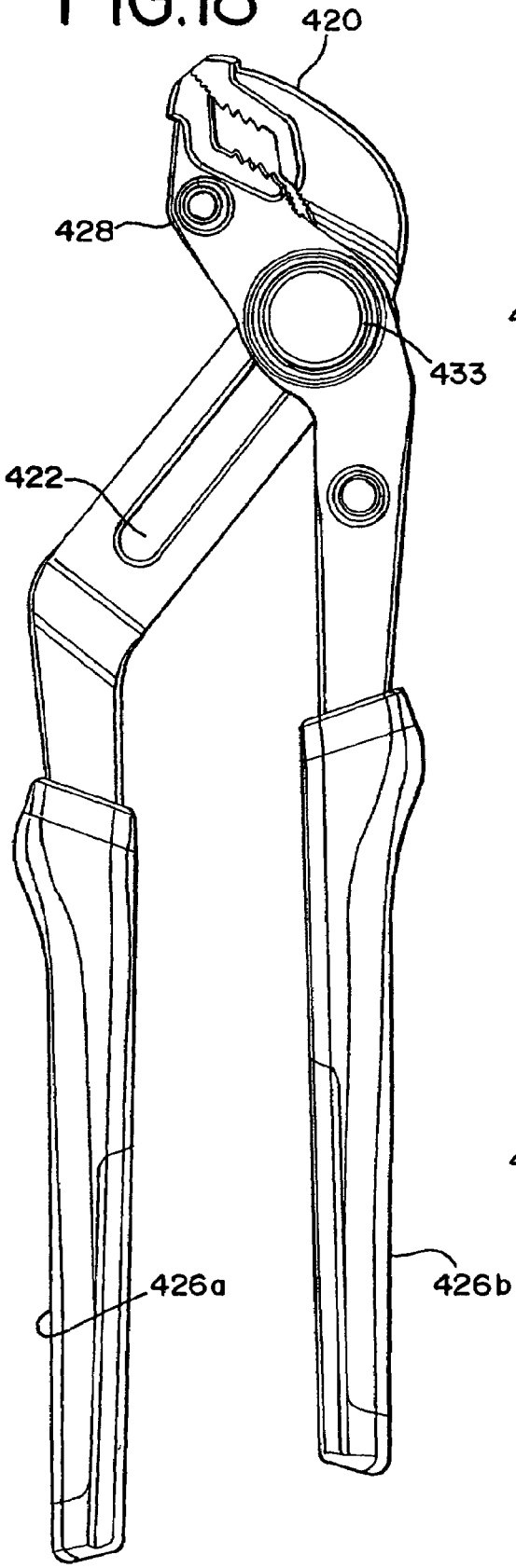
FIG. 18 is a front view of the quick adjusting pliers device of FIG. 17, with the device in the closed position.
Figure 19:
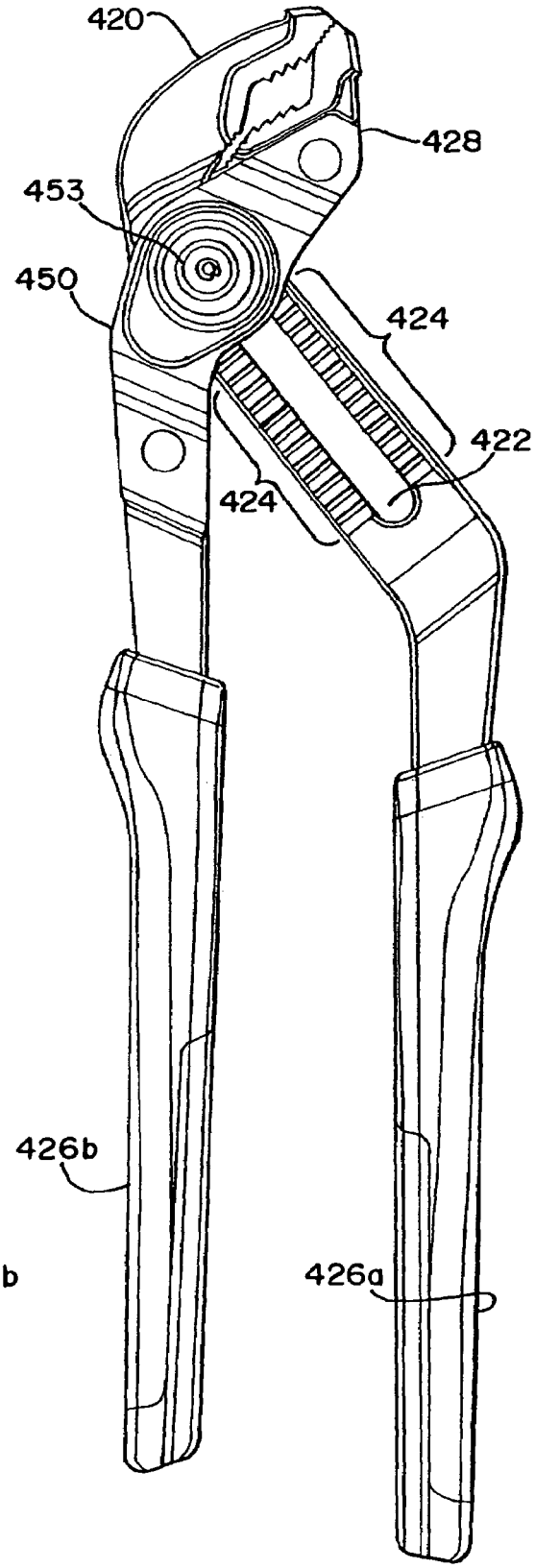
FIG. 19 is a back view of the quick adjusting pliers device of FIG. 17, with the device in the closed position.

FIG. 16 illustrates a fourth embodiment of the present invention. Ridges 234 are curved and located at the upper end of slot 322. However, straight ridges can also be used. Handles 326*a* and 326*b*, slot 322, pin 329, and head 330 are similar to, and function the same as corresponding items 26*a*, 26*b*, 22, 29 and 30, as described in the embodiment of FIGS. 1-9. Tongue element 332 has an extending portion (not shown) and tooth 338. With curved ridges, as shown, only one tooth 38 can be used. With straight ridges, one or more teeth 38 can be used. Tongue element 332 utilizes a raised surface 333 instead of a button to pull tooth 338 out of ridges 324 in a lever-like fashion. A spring (not shown) used in any of the previous embodiments may be used in the fifth embodiment.

FIGS. 17-20 illustrate a fifth embodiment of the present invention. A top jaw 420 is integrally attached to a bottom handle 426*a*. The top jaw 420 has a slot 422 formed therein and has a series of straight ridges 424 formed around the slot 422 on the back side of top jaw 420. Curved ridges can also be used.

A bottom jaw 428 is integrally attached to a top handle 426*b* and has an opening 427 for receiving pin 429. Pin 429 pivotally connects to jaw 420, bottom jaw 428, a button 433 and a spring 434. Handles 426*a* and 426*b* have an electrometric material shaped around their exteriors, making the handles slightly thicker and easier to grip.

Figure 17:
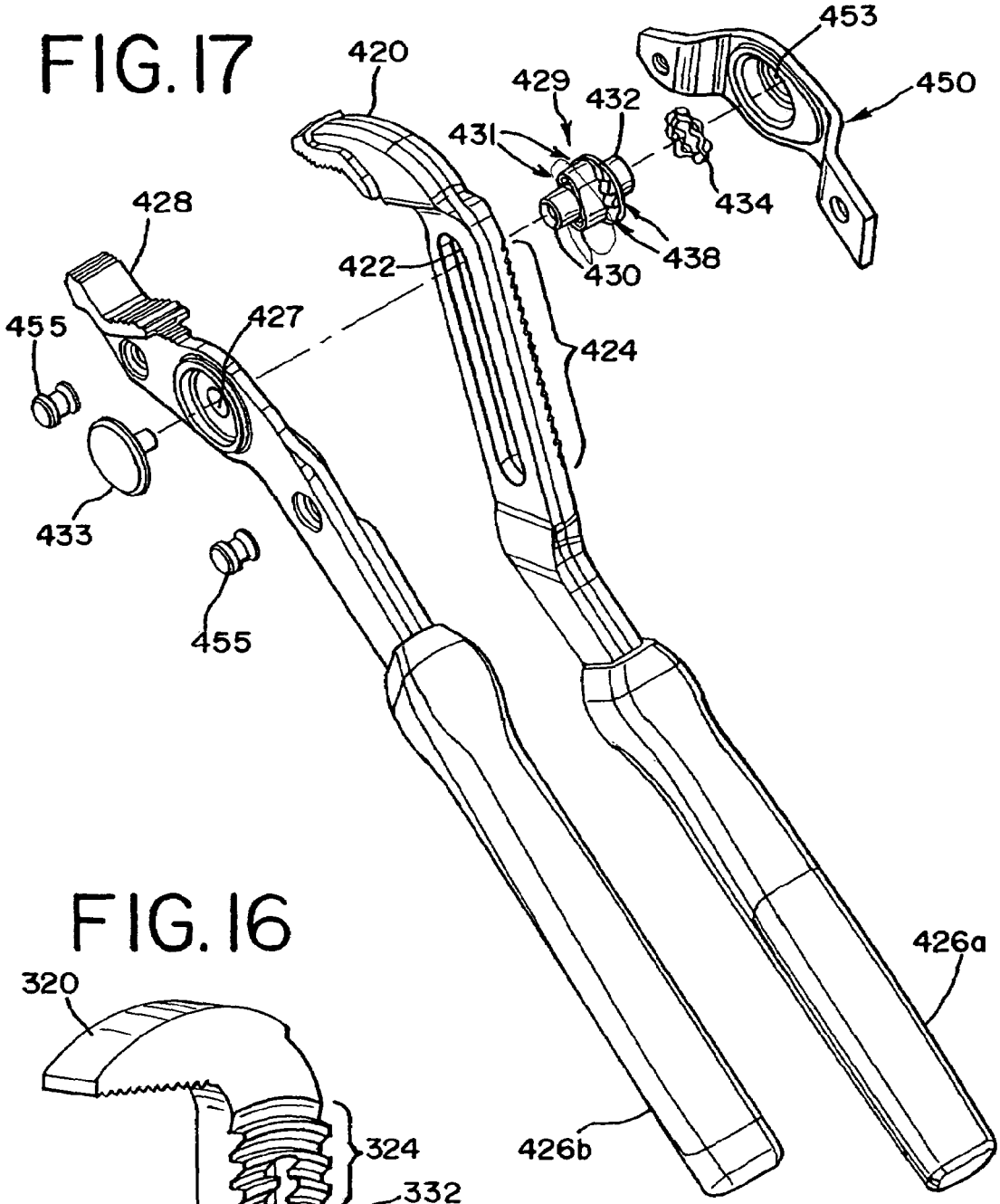
FIG. 17 is an exploded view of a quick adjusting pliers device according to a fifth embodiment of the present invention, with engagement of straight ridges adjacent to the pivot.
Figure 20:
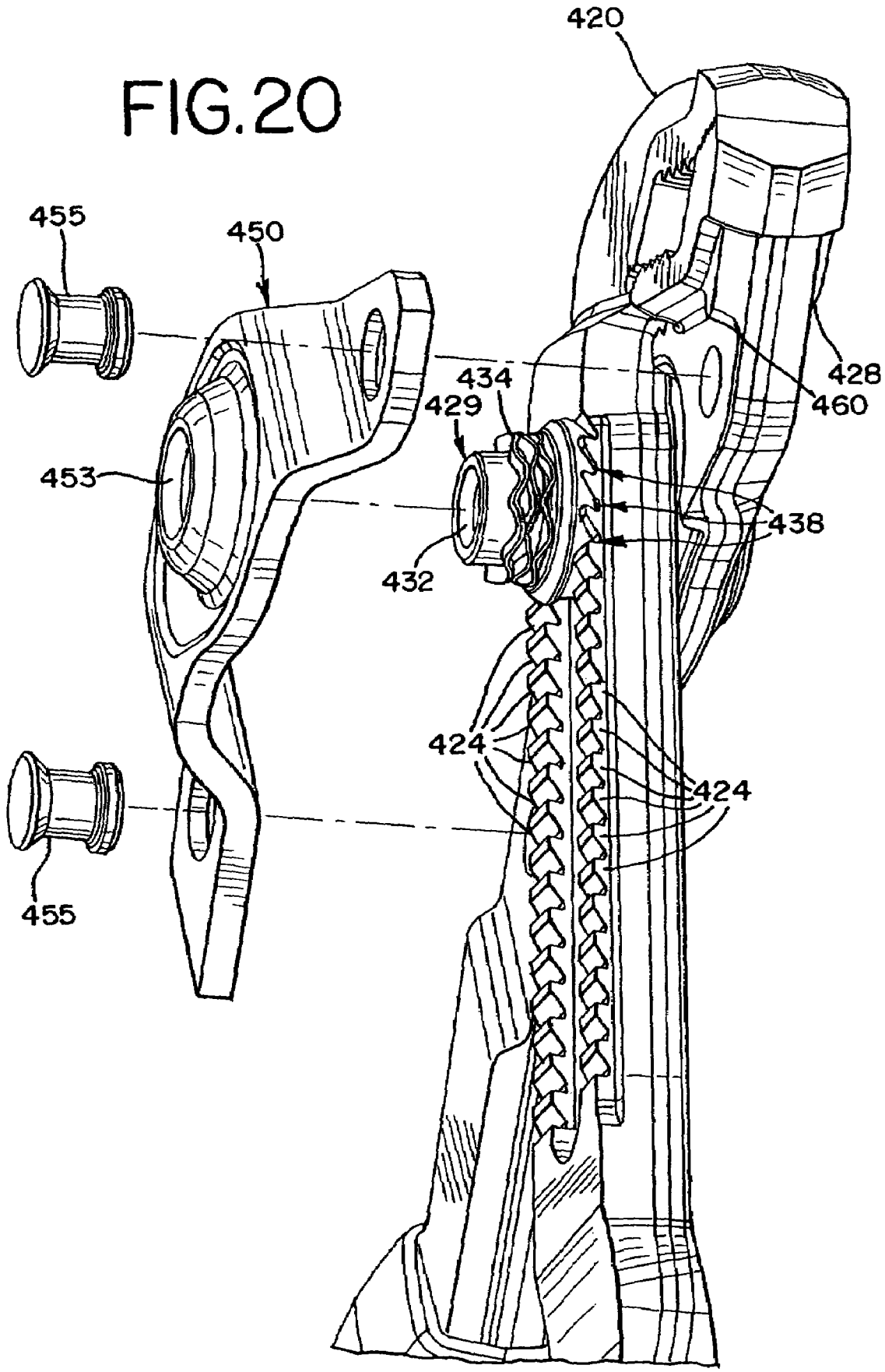
FIG. 20 is an exploded perspective bottom view of the quick adjusting pliers device of FIG. 17.

As shown in FIGS. 17 and 20, pin 429 includes a cylindrical bottom 430, an engagement element 431 and a head 432. Pin 429 is inserted through slot 422 and opening 427. Engagement element 431 is more oblong in shape than bottom 430 in order to fit within slot 422.

A bracket 450 is attached to the bottom jaw 428 and top handle 426*b* with rivets 455 so that engagement element 431 and head 432 are contained within a receptacle 453 of the bracket. Button 433 is connected to the free end of pin bottom 430. Spring 434 is placed around head 432 between engagement element 431 and receptacle 453 so as to bias engagement element 431 downward to contact ridges 424.

Engagement element 431 has teeth 438 that engage at least one of the series of ridges 424. Placing the teeth adjacent to the pivot in this embodiment provides a more positive and reliable engagement with ridges 424. With straight ridges, as shown, one or more teeth can be used. With curved ridges, only one tooth can be used.

In order for the jaws of the device to clamp an object, teeth 438 engage at least one of the series of ridges 424 corresponding to the size of the object being clamped. Top jaw 420 and bottom jaw 428 pivot about a first axis that extends though a longitudinal axis of pin 429, which is translation ally fixed due to the engagement between the teeth and the correct ridges. When pressed, button 433 raises teeth 438 out of ridges 424. Thus, the engagement element 431 is moveable along the first axis from a first position wherein the engagement element engages at least one of the series of ridges to a second position wherein the engagement element does not engage any of the series of ridges. Engagement element 431 can then translate along a second axis that is perpendicular to the first axis so that bottom jaw 428 can move away from top jaw 420 to release an object.

In order to promote translation of pin 429 and bottom jaw 428 towards top jaw 420, ridges 424 are angled towards top jaw 402 while teeth 438 are angled away from top jaw 420. Pin 429 and bottom jaw 428 are thus able to freely translate towards the top jaw 420 while being prevented by the ridges 424 from translating away from the top jaw 420 unless button 433 is pressed. Accordingly, engagement element 431 is moveable relative to the ridges 424 to allow for engagement or disengagement with said ridges 424.

Bottom jaw 428 includes a stop 460 that prevents top jaw 420 from being opened too wide. The attachment of bracket 450 to bottom jaw 428 and top handle 426*b* allows for double shear, which minimizes the stress on the pin at the pivot point and effectively transfers the load to the bottom jaw.

It is intended that the foregoing detailed description be regarded as illustrative rather than limiting and that it be understood that it is the following claims, including all equivalents, which are intended to define the scope of this invention.

The invention claimed is:

1. A quick adjusting pliers device comprising:

a first jaw having a first handle, a slot and a series of ridges, wherein the ridges are located adjacent the slot;

a member extending through the slot;

a second jaw having a second handle and another opening for receiving the member; and an engagement element engaging at least one of the series of ridges in a first position, wherein the first jaw and second jaw pivot about a first axis that extends though a longitudinal axis of the member, and wherein the engagement element is moveable along the first axis from the first position to a second position wherein the engagement element does not engage any of the series of ridges, a bracket attached to said first jaw and containing said engagement element, said engagement element being biased to the first position by a biasing means where the biasing means is located between said bracket and said first jaw.

2. A quick adjusting pliers device comprising:

a first jaw having a first handle, a slot and a series of ridges, wherein the ridges are located adjacent the slot;

a member extending through the slot;

a second jaw having a second handle and another opening for receiving the member; and an engagement element engaging at least one of the series of ridges in a first position, wherein the first jaw and second jaw pivot about a first axis that extends though a longitudinal axis of the member, and wherein the engagement element is moveable along the first axis from the first position to a second position wherein the engagement element does not engage any of the series of ridges, said engagement element when in said first position allowing said first jaw to move relative to the second jaw in a first direction to change the size of the opening between said first jaw and said second jaw, said engagement element when in said second position allowing said first jaw to move relative to the second jaw in a second direction to change the size of the opening between said first jaw and said second jaw, said engagement element being biased to the first position by a biasing means.

* * * * *